United States Patent [19]

Guill

[11] 4,417,732

[45] Nov. 29, 1983

[54] ELECTRICAL CONSTRUCTION GAME

[76] Inventor: Andrew J. Guill, Rte. 3, Box 746, Houston, Tex. 77045

[21] Appl. No.: 261,898

[22] Filed: May 8, 1981

[51] Int. Cl.³ ..... A63F 3/00

[52] U.S. Cl. ..... 273/238; 273/276; 273/157 R

[58] Field of Search ..... 273/276, 238, 237, 157 R; 434/333, 340, 341

[56] References Cited

U.S. PATENT DOCUMENTS

| | | | |
|---|---|---|---|
| 1,284,513 | 11/1918 | West | 273/276 |
| 2,923,550 | 2/1960 | Blackman et al. | 273/157 R |
| 3,542,368 | 11/1970 | Ashley | 273/276 |
| 3,621,590 | 11/1971 | Olynick | 434/340 |
| 4,067,121 | 1/1978 | Waszmer | 434/340 |
| 4,210,335 | 7/1980 | Licciardi | 273/238 |

FOREIGN PATENT DOCUMENTS

| | | | |
|---|---|---|---|
| 509632 | 7/1939 | United Kingdom | 273/276 |

*Primary Examiner*—Richard C. Pinkham
*Assistant Examiner*—Scott L. Brown
*Attorney, Agent, or Firm*—Neal J. Mosely

[57] ABSTRACT

A puzzle-game consists of a plurality of jig saw-type puzzle boards with identical pictures and puzzle parts for play. The game is played competitively with suitable chance devices, such as dice. The number of playing pieces corresponds to the numbers which can be generated by the chance devices, i.e. eleven pieces where a pair of dice are used in the play. The individual playing pieces are numbered and the spots on the board where the pieces are to be played bear the same respective numbers. The pieces must be played in ascending order of the numbers from three to twelve and finally piece number two. Each player is allowed a predetermined, e.g. three, rolls of the dice on each turn of play to try to roll the number of the next piece to be played. The roll of a double one, i.e. "snake eyes", during play incurs a penalty. The play of the last piece requires the roll of the double one, hence the name of the game "snake eyes". A preferred embodiment of the game utilizes a picture of a voluptuous woman and the breast piece is the final piece played. The final piece played is provided with a pair of lights which are lighted when placed in position by an electric circuit built into the board.

6 Claims, 3 Drawing Figures fig.1
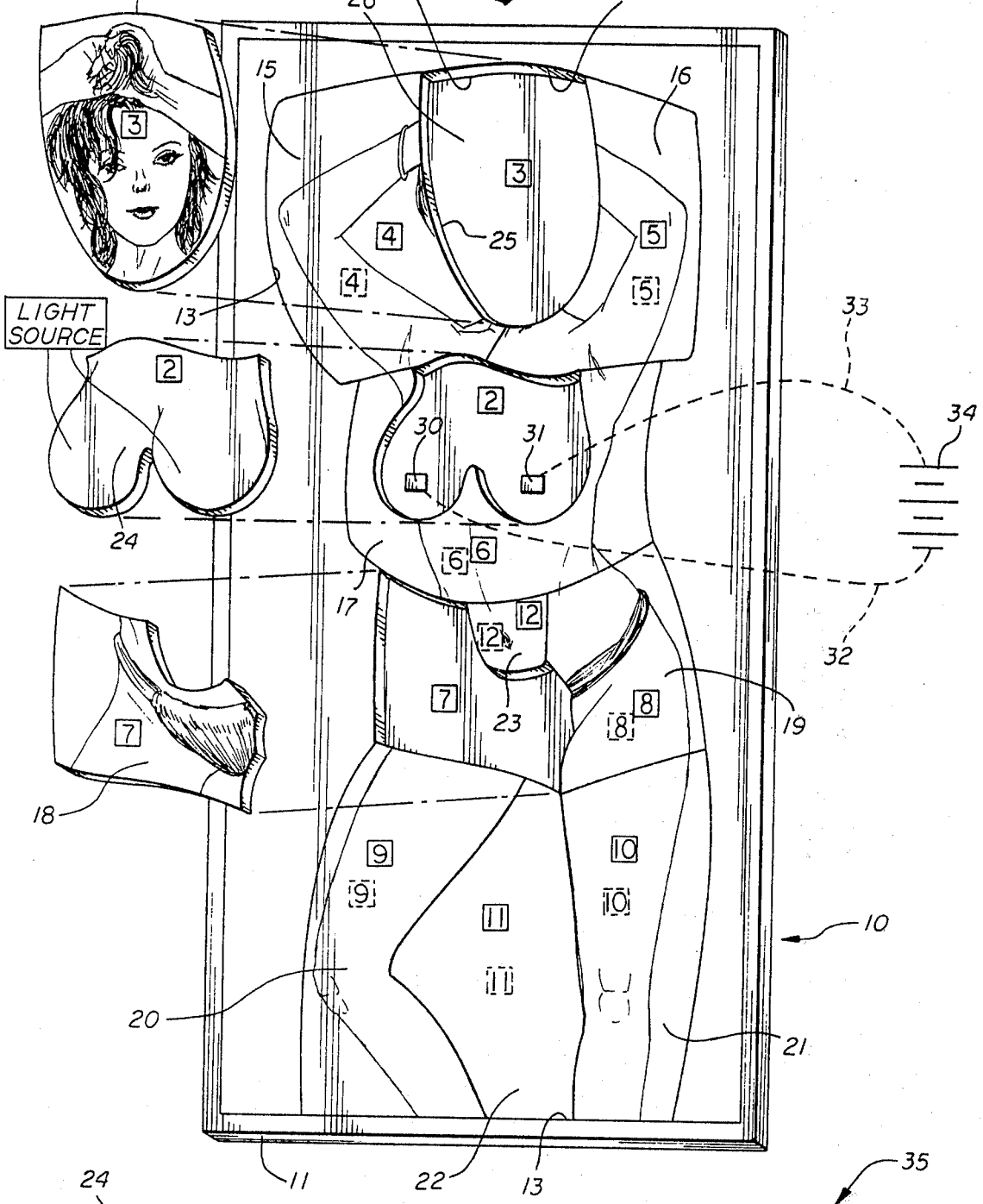
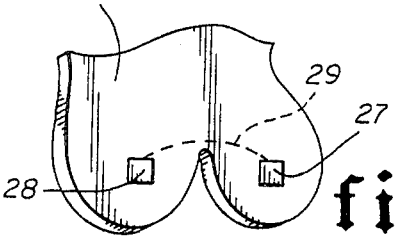
fig.2
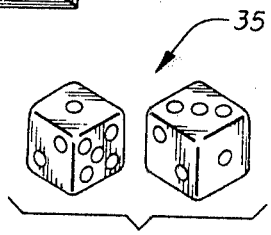
fig.3

ELECTRICAL CONSTRUCTION GAME

BACKGROUND OF THE INVENTION

1. FIELD OF THE INVENTION

This invention relates to new and useful improvements in games and more particularly to puzzle games adapted for use by adults. More particularly, the field of the invention is a puzzle game for play by two or more persons in which the order of play of the parts of the puzzle is dictated by chance.

2. DESCRIPTION OF THE PRIOR ART

Jig saw puzzles are well known in the art and usually comprise a plurality of interfitting component pieces which provide a representation of a meaningful design when the assembly is completed. In some cases the puzzle consists of a board having a recess in which the edge of the recess confines the pieces to the area in which they are to be assembled. In other cases, the borders of the puzzle are defined by the outer edge pieces without further boundary. Jig saw puzzles have in the past usually been put together as a simple problem solving game by a single person or occassionally with help. Jig saw puzzles have not previously been used in competitive play, particularly where the play of the pieces is dictated by the a suitable chance generating means.

The more relevant prior art relating to the field of this invention consists of a number of patents relating to puzzles and puzzle-games.

Johnson, U.S. Pat. No. 3,281,966 discloses an educational device comprising a manequin with pieces to be inserted or played thereon.

Zeve U.S. Pat. No. 3,013,800 discloses a toy which is constructed from component blocks or other parts by a child.

Beauchaine U.S. Pat. No. 3,394,935 discloses a game board having a recess in which puzzle pieces may be fitted to form a picture and having alphabetic characters which may be separately covered on the board, together with a self-erasing marking sheet provided for purposes of playing the game.

Glass U.S. Pat. No. 3,517,937 discloses a lighted jig saw puzzle.

Craig U.S. Pat. No. 4,205,850 discloses a puzzle-game of the jig saw type played by two parties attempting to assemble pieces from opposite sides of an opaque board.

SUMMARY OF THE INVENTION

One of the objects of this invention is to provide a new and improved puzzle-game particularly for adult play.

Another object of this invention is to provide a new and improved puzzle-game of a jig saw puzzle type having suitable means for directing the assembly of the puzzle by chance.

Another object of this invention is to provide a new and improved puzzle-game of the jig saw puzzle type wherein the number of pieces in play correspond to the numbers generated by a chance generating device such as one or more dice.

Still another object of this invention is to provide a new and improved puzzle-game of the jig saw puzzle type in which the play of the pieces is ordered by a chance generating means and including means to cause a signal light to be energized when the last piece is played by a particular player.

Another object of the invention is to provide a new and improved puzzle-game of the jig saw puzzle type utilizing a plurality of jig saw puzzle having numbered parts and in which individual players roll dice or other chance generating means to produce numbers corresponding to the number of the piece of the puzzle to be played.

Other objects of this invention will become apparent from time to time throughout the specification and claims as hereinafter related.

The above noted objects and other objects of the invention will be attained by a novel puzzle-game which consists of a plurality of jig saw-type puzzle boards with identical pictures and puzzle parts for play. The game is played competitively with suitable chance devices, such as dice.

The number of playing pieces corresponds to the numers which can be generated by the chance devices, i.e. eleven pieces where a pair of dice are used in the play. The individual playing pieces are numbered and the spots on the board where the pieces are to be played bear the same respective numbers. The pieces must be played in ascending order of the numbers from three to twelve and finally piece number two. Each player is allowed a predetermined, e.g. three, rolls of the dice on each turn of play to try to roll the number of the next piece to to be played.

The roll of a double one, i.e. "snake eyes", during play incurs a penalty. The play of the last piece requires the roll of the double one, hence the name of the game "snake eyes". A preferred embodiment of the game utilizes a picture of a voluptuous woman and the breast piece is the final piece played. The final piece played is provided with a pair of lights which are lighted when placed in position by an electric circuit built into the board.

BRIEF DESCRIPTION OF THE DRAWINGS

FIG. 1 is an isometric view of a jig saw puzzle comprising a preferred embodiment of this invention with several of the pieces shown in exploded relation to the puzzle board.

FIG. 2 is a detail view, in isometric form, of the reverse side of the last of the playing pieces to be played showing the electrical connection for signal lights carried by the playing piece.

FIG. 3 is an isometric view of a pair of dice constituting a preferred form of chance means for use in the play of this game.

DESCRIPTION OF THE PREFERRED EMBODIMENT

Referring to the drawings by numerals of reference, and more particularly to FIG. 1, there is shown a puzzle-game 10 comprising a board 11 which is of substantial thickness and has a recess 12 cut into the surface thereof having a peripheral edge 13 which defines the peripheral outline of the puzzle pieces when assembled.

The puzzle consists of a plurality of playing pieces which fit into the peripheral edge 13 of recess 12 and define a suitable design or figure when assembled. The individual playing pieces are numbered sequentially, as will be subsequently described, and the total number of the pieces corresponds to the number of the random numbers that can be generated by a chance generating device used with the game.

Where the puzzle uses a large number of pieces, a suitable chance device must be used which would generate exactly the same numbers as the total number of the pieces. In this embodiment of the game, there are eleven playing pieces and the chance generating device used is a pair of dice which can generate eleven different numbers when thrown.

There are provided eleven pieces to this puzzle ten of which are numbered sequentially from 14 to 23 bearing respective indicia on the face of the pieces in the numbers from three to twelve, respectively. The twelfth playing piece 24 is the last piece to be played and bears the indicator number 2 on the surface of the playing piece. The recess 12 defined by peripheral edge 13 is further subdivided by a plurality of lines 25 drawn on the flat recessed area 26 constituting the supporting surface for play of the puzzle pieces.

The plurality of lines 25 are drawn on the flat playing area 26 to define the shape of the individual playing pieces to be played in that particular area. Each distinct playing area marked off by the lines 25 bears numerical indicia corresponding to the number on the face of the piece of the puzzle to be played thereon. Thus, each space on the supporting area 26 is numbered and the corresponding piece to be played thereon bears the same number on the face of the puzzle piece.

Piece 24, which is the last piece to be played in accordance with the rules of the game, carries a pair of signal lights which have base portions extending through the playing piece to the rear as seen in FIG. 2. The bases of lights are interconnected by a suitable electrical connector 29 indicated schematically in dotted line in FIG. 2. The flat playing area portion into which puzzle piece 24 fits is provided with electrical contacts 30 and 31 which are positioned to make contact with the base portions of the signal lights. Contacts 30 and 31 are connected by electric leads 32 and 33, shown schematically in dotted lines, to opposite sides of as battery or other suitable electric power source 34. The play of the pieces of the puzzle is directed by a pair of dice 35 shown in FIG. 3.

PLAY OF THE GAME

In the preferred form of this game, there are two of the playing boards 11 provided for competitive play by two or four players. Additional playing boards could be used for play by three or more players with the understanding that the game may be played with one player playing a board or two players playing a board as partners against another player or pair of players playing another board. Each board is provided with eleven puzzle pieces, as described above, and a pair of dice are provided for use in play of the game. Optionally, a pair of dice may be provided for each player in the game.

The preferred form of the game is a "adult" game in which the puzzle assembled is a picture of a voluptuous woman. The individual pieces, as described above, are numbered on their faces from two through twelve and the corresponding areas into which the pieces fit are likewise numbered. It is, of course, within the scope of the concept of this game to eliminate the identifying numbers from the playing area on which the pieces are played and merely utilize the numbers on the playing pieces themselves.

To start the game, each person rolls the dice and the player rolling the highest score on the dice then starts. The pieces must be fitted into the playing area by each respective player in numerical order from three to twelve, with the piece bearing number two being the last piece to be played. Each player has three rolls of the dice to roll the number of the playing piece which is to be played next onto the playing board.

At the start of the game, the player must first roll the number three in order to play the first playing piece. On his next turn to play he must then roll number four or, if he has not yet rolled number three, must roll three in order to play that piece. If a player does not roll the number of the piece to be played in three rolls, he passes the dice and is not allowed to play a piece on that round. If he rolls the desired number on the first or second roll then the remaining rolls are not used.

If double one, i.e. "snake eyes", is rolled at any time before completing the play of pieces numbered three through twelve, a penalty is assessed against the player. In this embodiment of the invention, the player must remove one piece of the puzzle, and in addition looses his next turn of play. The player may choose any piece, which will usually be the easiest piece to replace, but first must replace that piece by roll of the dice before he can continue to complete the remaining parts of the puzzle. If there are no pieces to remove at the time the player has rolled "snake eyes" he simply looses the next turn.

As a bonus play, if a player should roll a double on a number needed to play a particular piece, he obtains an additional six free rolls (or other suitable bonus) to try for the next puzzle piece. As an example, if the next piece to be played is a six, a roll of double three will allow the piece to be played and obtain the bonus for playing the next piece.

The play of the game continues competively with each player ultimately rolling the dice and attempting to obtain the number which will allow pieces of the puzzle to be played. Pieces will continue to be added to and/or removed from the playing board by the respective players until one of the players has completed the addition of all of the playing pieces to the board to complete the puzzle. The numbers two and twelve are the most difficult numbers to roll since there are only a single set of numbers on the dice out of thrity-six possibilities which will produce those respective numbers. The numbers twelve and two, respectively, are therefore the last pieces to be played. The piece bearing the number twelve is the last piece in regular play to be inserted and the piece bearing number two which requires the roll of "snake eyes", i.e. double one, is the last piece to be played.

The play of puzzle piece 24 which bears the indicator number two on the face of the piece is the last one to be played and when placed in position brings the bases of signal lights into contact with electrical contacts 30 and 31 which complete the circuit from the battery 34 to cause the lights to be lighted.

While this invention has been described fully and completely with special emphasis upon a single preferred embodiment, it should be understood that the invention may be carried out using puzzles of varying numbers of pieces and suitable equivalent chance means for generating numbers corresponding to the number of puzzle pieces used in the game. The easiest modification of the game would be one using a suitable number of pieces for play with three dice instead of two. Other alternative possibilities include the use of other numbers of puzzle pieces and a spinner or other suitable means for generating numbers required for the play of those pieces in sequence.

I claim:

1. A competitive puzzle-game for play by a plurality of players comprising at least one game board of substantial thickness and having a recessed area comprising a flat portion surrounded by a peripheral edge defining the outline of the outer periphery of said puzzle and inner markings in said flat recessed portion outlining the location of eleven separate playing pieces, each marked area for play of a jig saw puzzle piece bearing a selected number, eleven playing pieces for said board, each of said pieces having a shape fitting a selected marked area on said board and bearing a number corresponding to the number on such area, a pair of dice for use by each player for generating random numbers from two to twelve, and said pieces are played competitively by a player on said board according to numbers generated by said dice in the order of numbers from three to twelve and finally piece number two, each player being allowed a selected number of throws of said dice to produce the number of the piece to be played, after which he loses his turn, playing piece numbered two, the last piece to be played includes at least one signal light, and said board includes electric circuit means in said recessed area marked area number two cooperable with said puzzle piece number two to energize said light, whereby the rolling of the number two, having the lowest probability, results in completion of the board and illuminates the light.

2. A puzzle-game according to claim 1 in which the roll of a number two by the pair of dice prior to the time that piece number two can be played resulting in a penalty to the player rolling the same.

3. A puzzle-game according to claim 1 in which said eleven pieces bear the picture of a woman's body when assembled.

4. A puzzle-game according to claim 1 comprising a plurality of said game boards for play by a plurality of players competitively, each player operating said dice to determine the play of said pieces on his board.

5. A puzzle-game according to claim 4 in which each player is allowed a selected number of throws of the dice to generate the required number of the piece to be played, and said pieces being required to be played in numerical order from three to twelve and finally piece number two, the roll of a number two by the pair of dice prior to the time that piece number two can be played resulting in a penalty to the players.

6. A puzzle-game according to claim 4 in which said pieces bear the picture of a woman's body when assembled.

* * * * *